US006314681B1

(12) United States Patent
Moody

(10) Patent No.: US 6,314,681 B1
(45) **Date of Patent: *Nov. 13, 2001**

(54) WINDOW OPERATOR HAVING A LINEAR DRIVE MECHANISM

(75) Inventor: Roy Malcolm Moody, Wellington (NZ)

(73) Assignee: Interlock Group Limited (NZ)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/392,959

(22) Filed: Sep. 9, 1999

(30) Foreign Application Priority Data

Sep. 9, 1998 (NZ) ..... 331805

(51) Int. Cl.[7] ..... E05F 11/24; E05F 11/34
(52) U.S. Cl. ..... 49/343; 49/345; 49/346
(58) Field of Search ..... 49/346, 345, 344, 49/343, 341

(56) References Cited

U.S. PATENT DOCUMENTS

| | | | | |
|---|---|---|---|---|
| 7,998 | * | 3/1851 | Sneers | 49/343 |
| Re. 034,230 | | 4/1993 | Tucker . | |
| 1,475,012 | * | 11/1923 | Harris | 49/343 |
| 2,778,630 | * | 1/1957 | Pearson | 49/82.1 |
| 2,817,978 | * | 12/1957 | Kennedy et al. | 74/424.8 R |
| 4,241,541 | | 12/1980 | Von Klompenburg et al. . | |
| 4,253,276 | | 3/1981 | Peterson et al. . | |
| 4,497,135 | * | 2/1985 | Vetter | 49/280 |
| 4,617,758 | | 10/1986 | Vetter . | |
| 4,823,508 | * | 4/1989 | Allen | 49/252 |
| 4,887,392 | | 12/1989 | Lense . | |
| 5,623,784 | | 4/1997 | Kuersten et al. . | |
| 5,815,984 | * | 10/1998 | Sheets et al. | 49/246 |

FOREIGN PATENT DOCUMENTS

| | | | | |
|---|---|---|---|---|
| 573151 | * | 12/1993 | (EP) | 49/345 |
| 300910 | | 6/1998 | (NZ) . | |

* cited by examiner

*Primary Examiner*—Gregory J. Strimbu
(74) *Attorney, Agent, or Firm*—Blakely Sokoloff Taylor & Zafman

(57) ABSTRACT

A window operator for control of the opening and closing of a window sash mounted with a window frame. The window operator may include a drive mechanism, a drive element movable on a rectilinear path by the drive mechanism, and a first linkage of which a primary point of rotation is fixed relative to the drive mechanism. Additionally, the window operator may include a first mounting for attachment of the first linkage to the window sash at a first position, a second linkage connected to the drive element, and a second mounting for attachment of the second linkage to the window sash at a second position. Here, the second position may be closer to the hinged side of the window sash relative to the window frame than the first position. The window operator may further include an interconnection linkage pivotally coupling the first and second linkages.

18 Claims, 7 Drawing Sheets

WINDOW OPERATOR HAVING A LINEAR DRIVE MECHANISM

BACKGROUND OF THE INVENTION

This invention relates to a window operator.

Typically a window operator will include a housing which incorporates a winding handle. The housing will be surface mounted on a window frame. The handle drives via gears a drive arm coupled to the window sash to be driven between open and closed positions in the frame by the operator.

Due to the use of gears, high loadings can during operation be applied to the drive arm. This is due to poor mechanical advantage when moving the window from a closed position and possibly when moving the sash from a fully open position. These loads, when initiating motion of the window can lead to wearing of the operator components, more particularly the gears and in extreme situations where stickion is a factor (eg when a window is being opened for the first time after a long period of inaction) breakage of components can occur.

Window operators are surface mounted to the window frame or surround. The window operator housing is thus readily apparent and can spoil the aesthetic appeal of the window frame/surround.

SUMMARY OF THE INVENTION

It is therefore an object of the present invention to provide a window operator which exhibits good mechanical advantage when initiating motion of a window sash.

It is a further object of the present invention to provide a window operator whereby the mechanical operating elements to apply a driving force to the drive arm can be concealed within the window frame/surround.

Broadly, in one aspect of the invention there is provided a window operator including a mounting means, an elongate threaded member mounted with the mounting means, drive means to apply a rotational movement to the elongate member, a threaded element located on the elongate member, a drive arm pivotally coupled to the threaded element and a link pivotally coupled to the drive arm and adapted for coupling to a window sash.

In a preferred form of the invention the link is pivotally coupled to an arm which is pivotally coupled at one end to the mounting means and at another end is adapted for coupling to a window sash.

According to one form of the invention the drive arm is pivotally coupled to a second link which is adapted for pivotal coupling to a window sash.

The preferred form of the invention has the mounting means formed by an elongate plate which is engageable within a cavity in a window frame or surround.

Broadly in a second aspect of the invention there is provided a window operator including an elongate substantially flat mounting means, an elongate threaded member rotatably mounted on the mounting means, a drive means coupled to the elongate threaded member, a nut threaded on the threaded member, a drive arm coupled to the nut and an input shaft coupled to the drive means, the arrangement being such that the mounting is able to be located within a cavity in a window frame or surround with the input shaft projecting from the frame or surround and the drive arm extending from a part of the frame or surround at an opposite side to that from which the input shaft projects.

In a preferred form the input shaft is adapted for connection to a handle. The connection can be via a knuckle joint.

Preferably, the drive arm is adapted to couple to a sash and is pivotally connected to a first link which is pivotally connected to an arm, said arm being pivotally coupled to the mounting means and adapted at a distal end to be coupled to a window sash.

DESCRIPTION OF THE PREFERRED EMBODIMENTS

Figure 1:
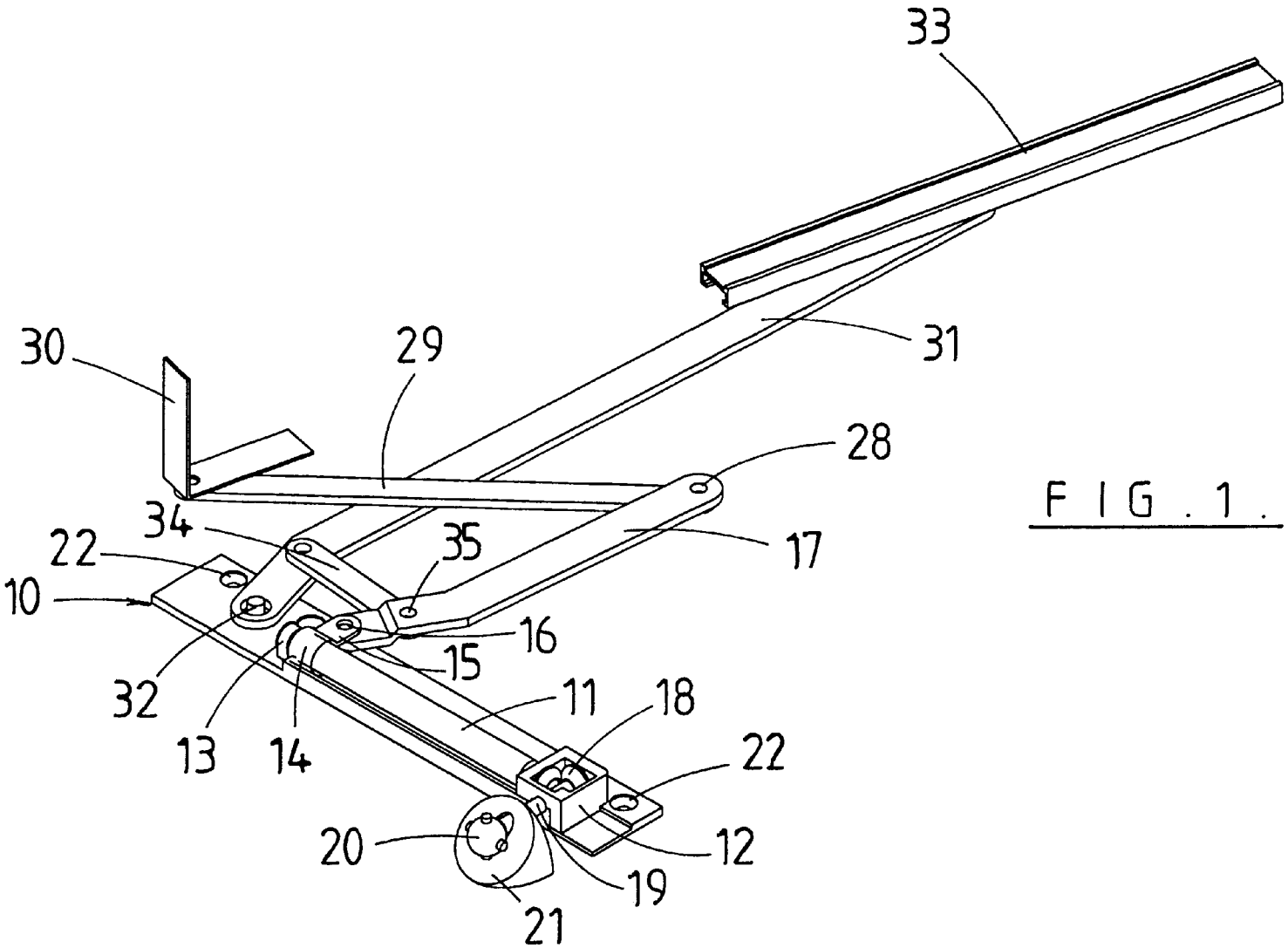
FIG. 1 is a perspective view of the window operator incorporating the present invention wherein the operator is able to be concealed within the frame or surround of a window.

Referring firstly to FIG. 1, the window operator includes a mounting base 10 which carries a lead screw 11. One end of the lead screw 11 is journalled in a suitable bearing in a retainer 12 while the opposite end of the lead screw is journalled in a suitable bearing 13. A nut 14 is threaded onto the lead screw 11. The nut 14 includes a transversely projecting flange 15 which via a pivot 16 is coupled to a drive arm 17.

Located within the retainer 12 are meshing bevelled gears 18. One of the bevelled gears 18 is mounted on a shaft 19 which extends from the retainer 12. The other gear 18 is connected to the lead screw 11.

The distal end of shaft 19 is provided with a means for connecting to a handle. This can be a knuckle joint 20 adapted for connection to an operator handle. To present the operator handle in the correct orientation relative to the base 10 and prevent it fouling with a window sill or the frame of the window, a spacer block 21 is provided.

Figure 6:
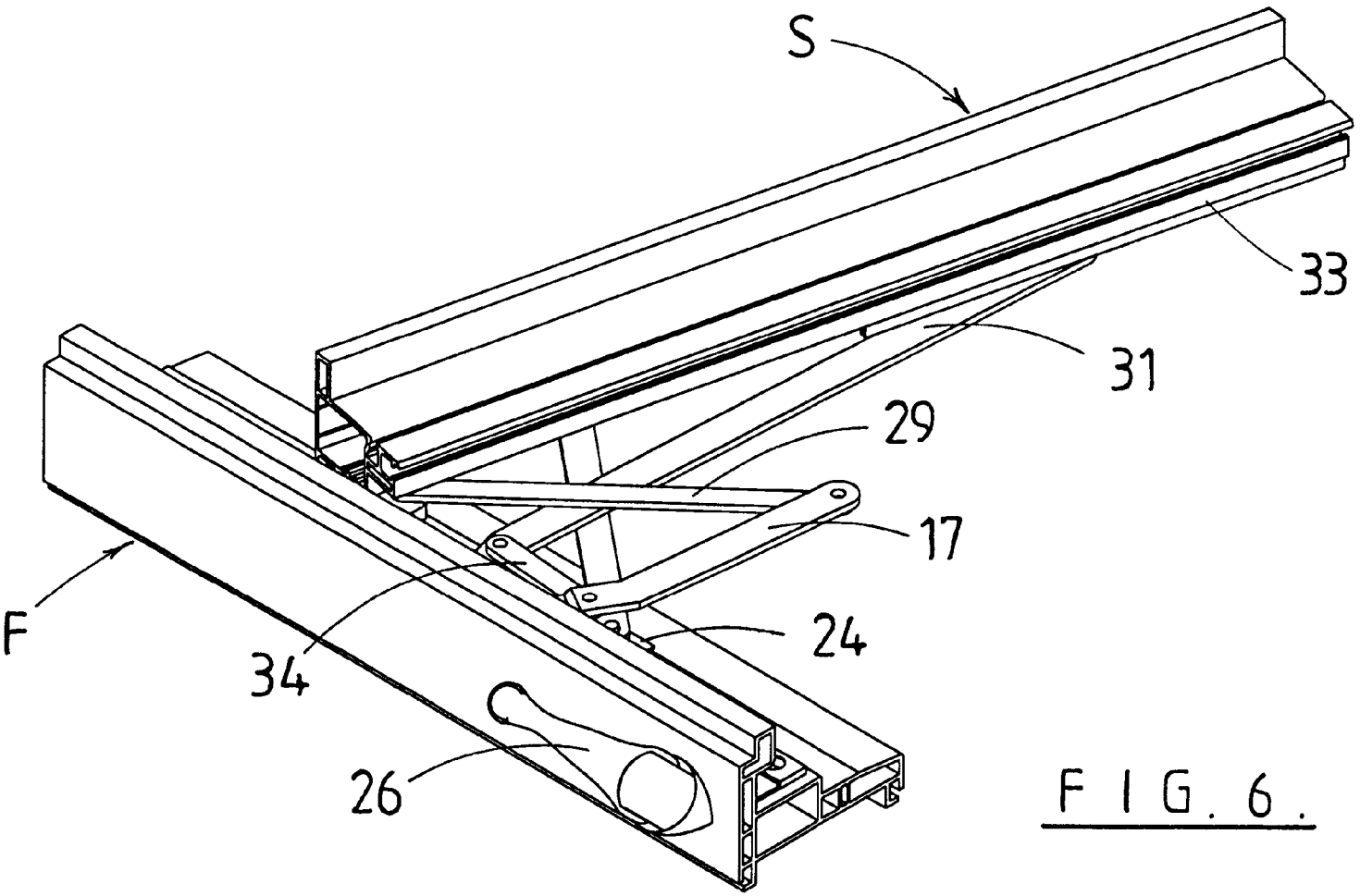
FIG. 6 is a perspective view of the operator of FIG. 1 mounted within a window frame.

The mounting base 10 with the drive components (being lead screw 11, nut 14, retainer 12 and bevelled gears 18/shaft 19) are intended for location within the cavity of a window frame as shown in FIG. 6. Openings 22 formed in the base 10 provide for the base to be fixed in position.

Suitable slots/openings may be formed in the walls of the window frame F defining the cavity in which the operator is concealed as may be necessary (depending on the type of frame section) to permit extension of the drive arm 17, long arm 31 (as hereinafter described) and (in a substantially opposite direction) drive shaft 19. With the generally open cavity of the example of a frame section shown in FIG. 6 it will only be necessary for cut out to be provided for the drive shaft and possibly to accommodate the or part of the retainer 12.

Figure 2:
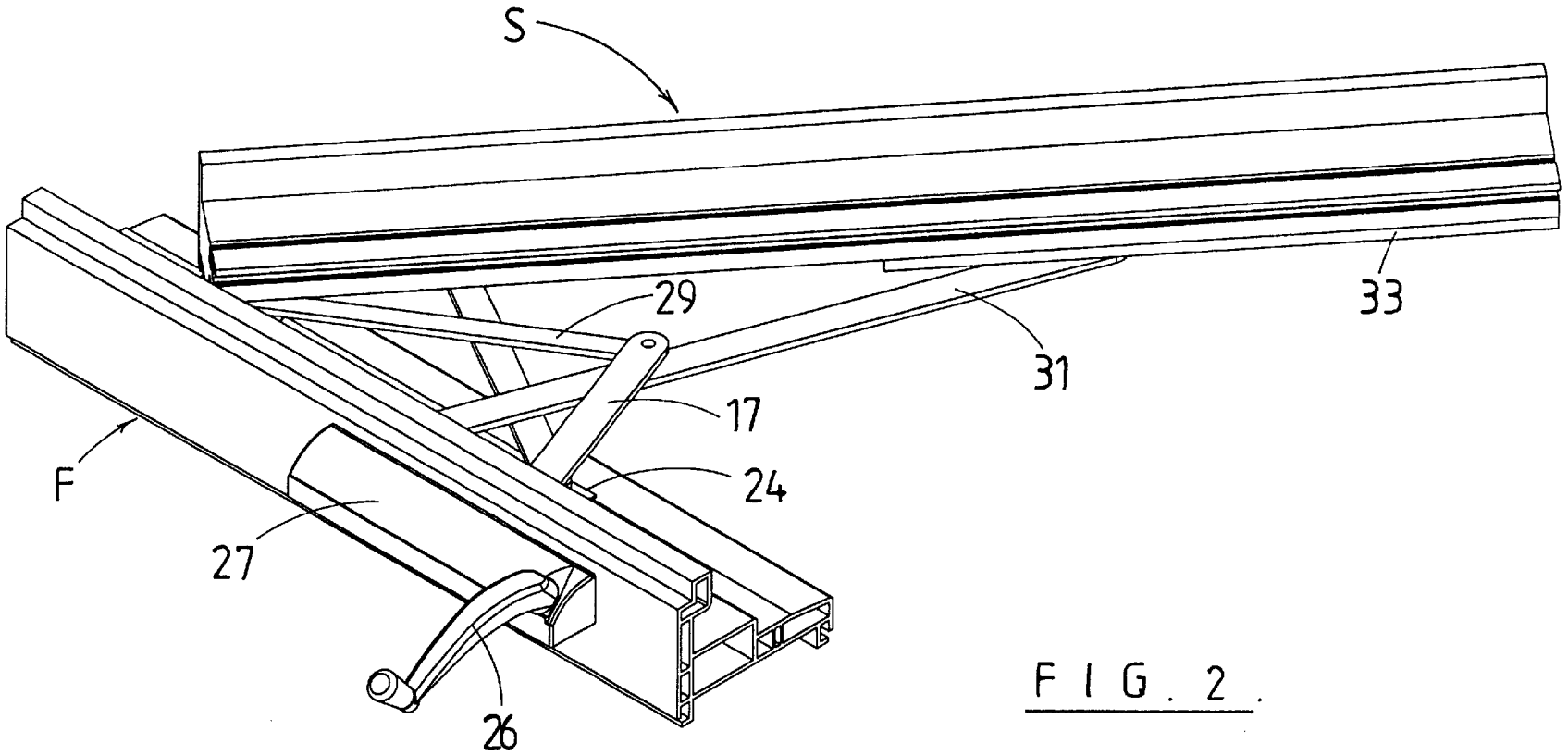
FIG. 2 is a perspective view showing part of a window frame/surround with the operator of the type shown in FIG. 1 surface mounted to the window frame/surround.
Figure 3:
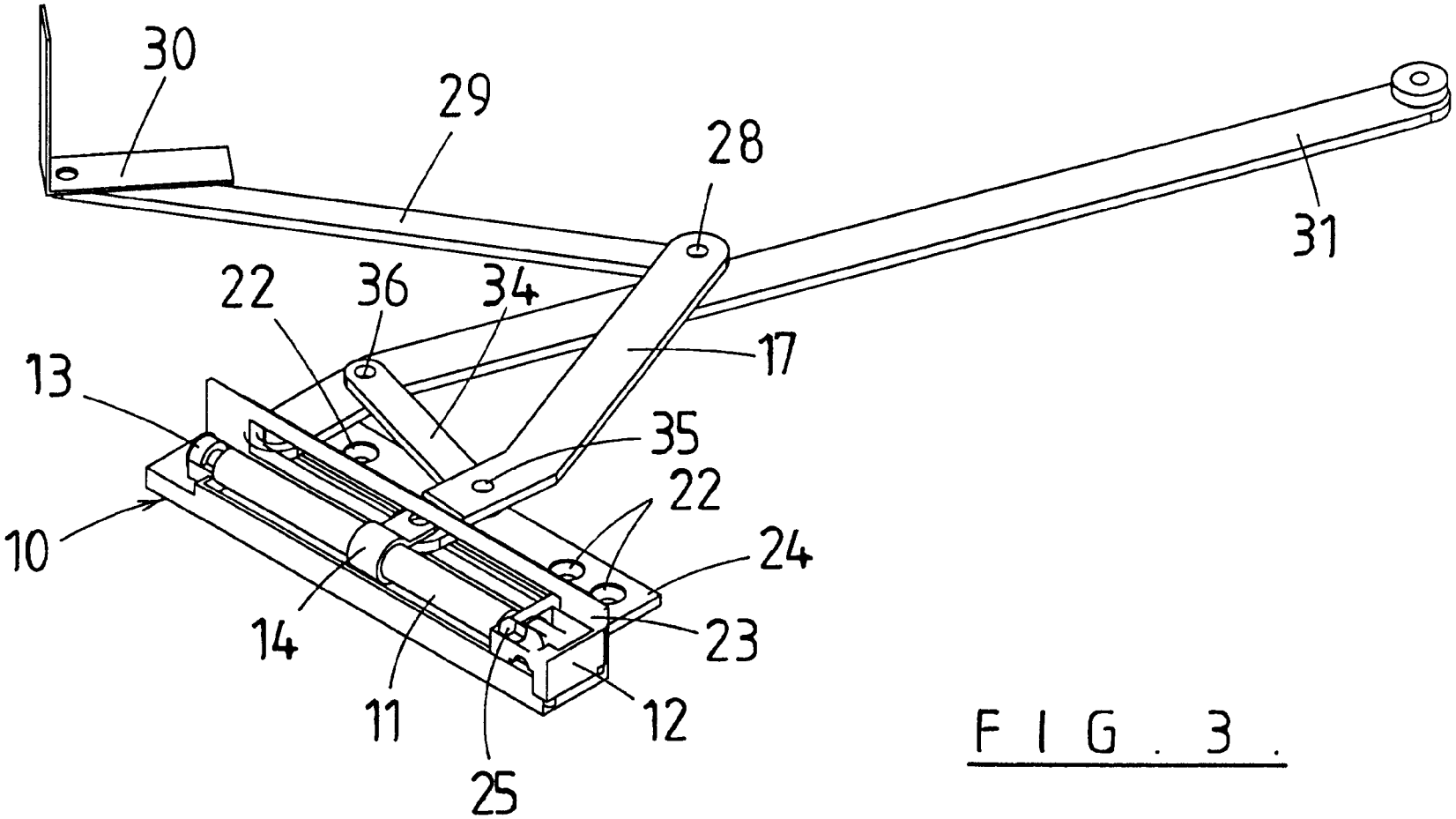
FIG. 3 is a partially disassembled view of the window operator as shown in FIG. 2.

In an alternative embodiment and a more conventional manner as shown in FIGS. 2 and 3, however, the base plate 10 can be provided with an upstanding wall 23 and a projecting land or flange 24. A cover 27 is engageable with the back wall 23 and base 10 to cover the working mechanism. In such an arrangement, an input shaft 25 projects at an angle from the retainer 12 and drives a bevelled gear which meshes with the bevelled gear at the end of the lead screw 11. An operator handle 26 is in a conventional arrangement attached to the input shaft 25.

The distal end of the drive arm 17 is, in the form shown in FIGS. 1 to 3, , coupled via pivot 28 to a connect arm 29. The distal end of this connect arm 29 is pivotally coupled to a sash bracket 30. In use this sash bracket 30 is mounted in a conventional manner to the sash (more particularly a corner) of the window.

A long arm 31 is pivoted at 32 to the base plate 10. The other end of the long arm 31 is mounted to a shoe, carriage, follower, slider or the like slidingly engaged in a track 33. As can be seen in FIG. 2, this track 33 is mounted to the sash S (more particularly a bottom edge) of the window.

A link 34 is pivoted at pivot 35 to drive arm 17, this pivot 35 being located adjacent pivot 16. The other end of the link 34 is pivoted at 36 to the long arm 31. Once again, pivot 36 is located adjacent to pivot 32.

In use, a rotation to shaft 19 applied by handle 26 or the handle connected to knuckle joint 20 causes the lead screw 11 to rotate. The direction of rotation determines whether the nut 14 moves away from or toward the retainer 12. When the window sash is in the fully closed position, the nut 14 is at its closest position relative to retainer 12. In such position, the drive arm 17 and long arm 31 are located at their closest approach to the base 10 but extend in opposition directions.

Rotation of the lead screw 11 causes the nut 14 to move toward the bearing 13. This movement is via link 34 applied to long arm 31. Essentially the arrangement is such that the arm experiencing least resistance will tend to move.

At the initial opening of the window and indeed through a major part of the opening of the sash from a closed position, the long arm 31 and drive arm 17 (together with connect arm 29) move simultaneously. This, therefore, results at initial opening in the hinge side of the sash moving away from the frame (and hence clear the weather seals) while the non-hinged side of the window moves outwardly at a greater rate. At about 85% of opening of the window the long arm 31, however, ceases movement or at least significant movement while the drive arm 17 via connect arm 29 tends to pull on the hinged side of the sash to result in the window moving to its final fully open position.

Upon closing of a sash S from the fully open position the reverse procedure occurs with the hinged side of the sash moving initially via drive arm 17 and connect arm 29 followed afterwards by the long arm 31 moving at the same time as the drive arm 17/connect arm 29 to finally result in the sash being moved to the fully closed position.

Figure 4:
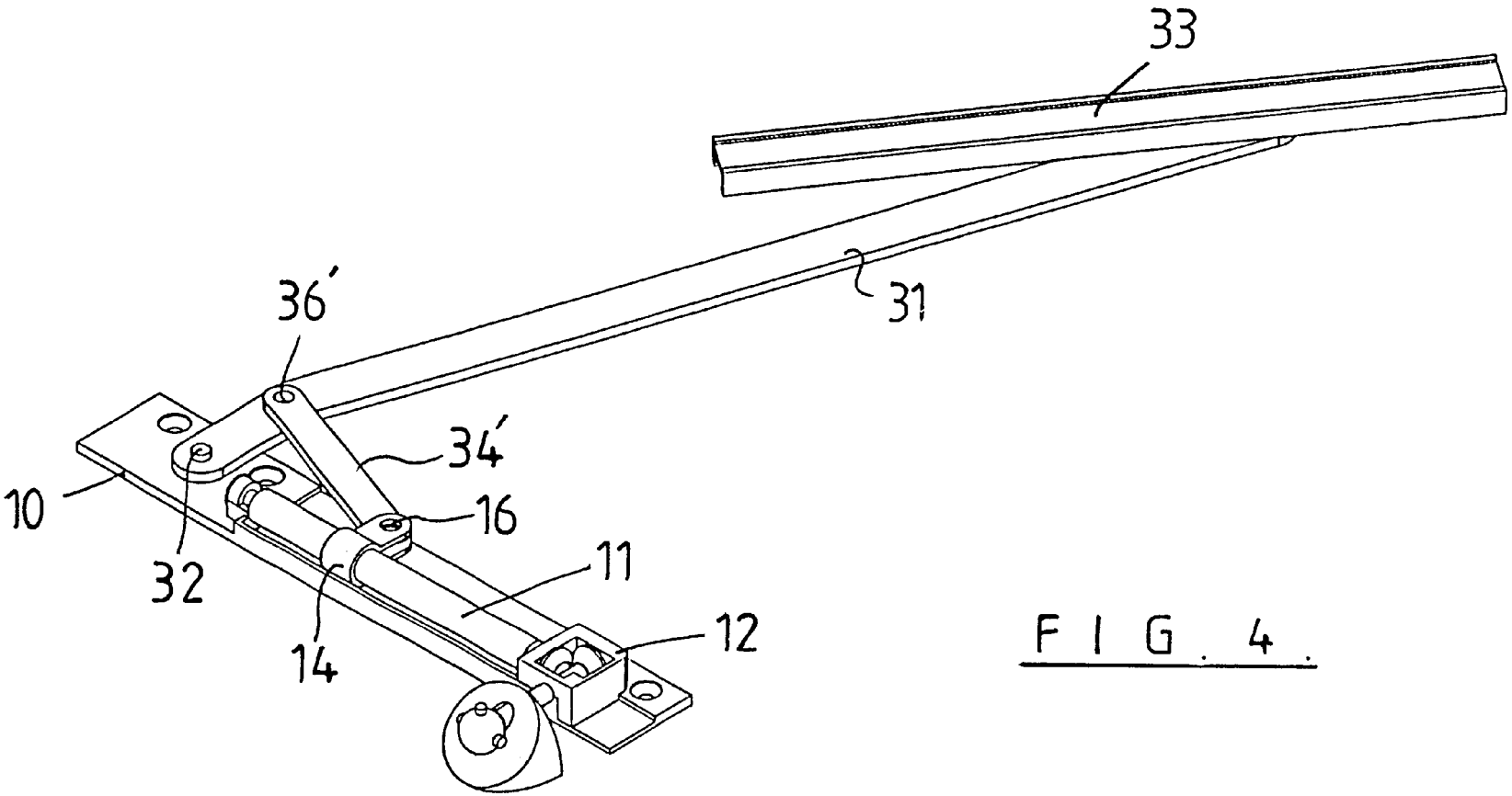
FIG. 4 is a modified form of the operator shown in FIG. 1.
Figure 5:
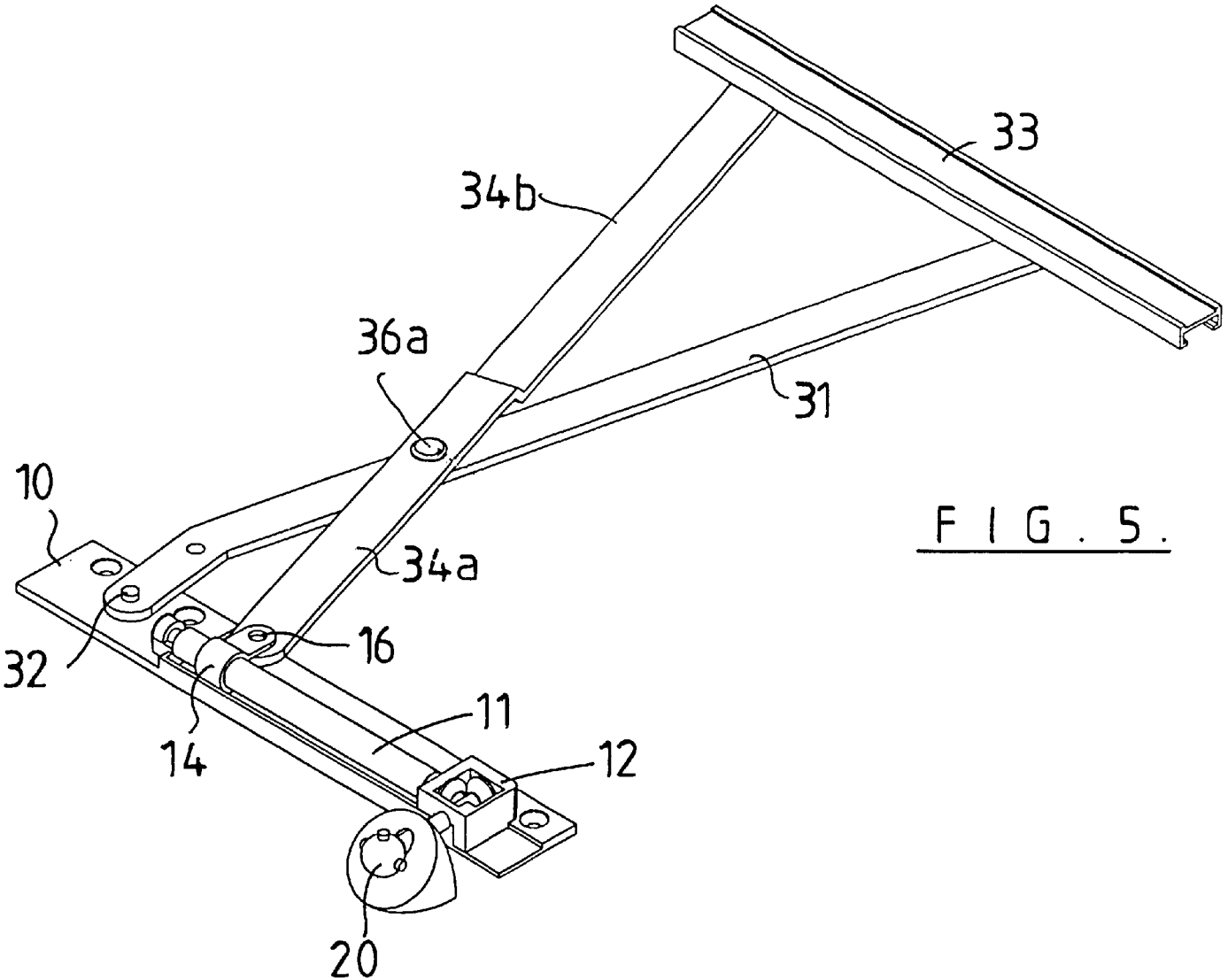
FIG. 5 is a perspective view of a further form of the window operator intended for control of an awning type window.

The invention is open to modification as can be seen from the embodiments shown in FIGS. 4 and 5. In the arrangement depicted in FIG. 4, the drive arm 17 and link 34 are embodied in a link 34' which extends from pivot 16 to the long arm 31 joining at pivot 36'. This single arm version of the operator therefore does not have the differential movement feature of the embodiment shown in FIGS. 1 to 3 and described above.

In FIG. 5 there is shown a modified form of the operator intended for an awning window. In this arrangement, the drive arm 17 and link 34 are embodied in an arm 34*a* which extends from pivot 16 to a pivot 36*a* on long arm 31. This arm 34*a*, however, extends via extension 34*b* to the track 33 to be engaged therewith via a slide, shoe or the like. Accordingly, as the nut 14 is moved along the lead screw 11 the long arm 31 and arm 34*a*, 34*b* "scissor" about pivot 36*a* thereby drawing track 33 toward or pushing track 33 away from the base 10 thereby resulting in closing/opening of the sash to which the track 33 is attached.

By use of the lead screw 11 and nut 14 a slim-line mounting base and drive mechanism is achieved which enables the operator to be concealed within a cavity in the window frame or surround. Equally, however, as shown in FIGS. 2 and 3 the operator can be mounted in a conventional manner to the surface of the frame/surround. The use of the lead screw and nut also provides a good mechanical advantage thereby lowering loads when initiating motion (especially from the closed position).

Figure 7:
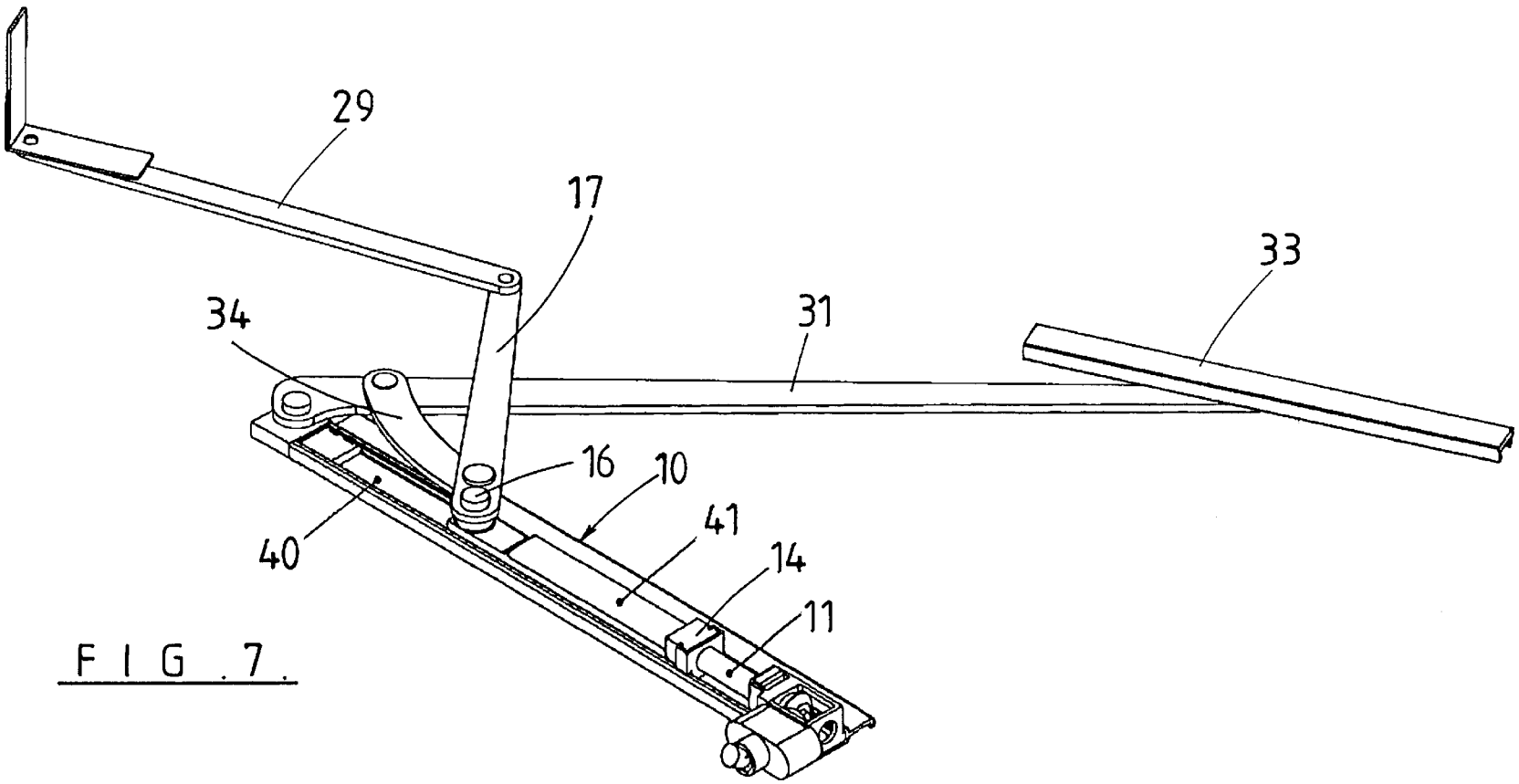
FIG. 7 is a view similar to FIG. 1 but of a modified form of the invention.

The operator according to the present invention is, of course, open to modification as will be appreciated by those skilled in the art, such modifications not departing from the scope of the invention. For example, as shown in FIG. 7, the base 10 could be of an extruded form providing a channel 40 in which a slider 41 is slidingly engaged. At one end of the slide, drive arm 17 is pivotally coupled via pivot 16.

At the other end of the slider 40, the nut 14 is incorporated and as with the previously described arrangement, is threaded onto lead screw 11. With this arrangement, the end bearing 13 of the arrangement shown in FIG. 1 is not required.

What is claimed is:

1. A window operator comprising:

a mounting base;

an elongate threaded member mounted on the mounting base;

a drive mechanism to apply a rotational movement to the elongate threaded member;

a threaded element located on the elongate threaded member and adapted to be movable between a first position which corresponds to a window sash driven by the window operator being in a closed position, and a second position which corresponds to the window sash being in a fully open position;

a drive arm pivotally coupled to the threaded element;

a first link pivotally coupled to the drive arm;

a first link coupling for coupling the first link to the window sash;

a second link mounted to pivot about a fixed point adjacent to the threaded element;

a second link coupling for coupling the second link to the window sash; and a coupling link pivotally coupled to the drive arm and the second link.

2. A window operator as claimed in claim 1 wherein the mounting base is formed by an elongate plate which is adapted to be engageable within a cavity in a window frame.

3. A window operator as claimed in claim 1 wherein the coupling link is pivotally coupled to the drive arm adjacent a pivot coupling of the drive arm to the threaded element, and said second link coupling is a slider mounted for sliding movement with a track.

4. A window operator in combination with a window frame, the window operator comprising:

an elongate substantially flat mounting base;

an elongate threaded member rotatably mounted on the mounting base;

a drive mechanism coupled to the elongate threaded member;

a nut threaded on the elongated threaded member;

a drive arm coupled to the nut and an input shaft coupled to the drive mechanism, wherein the mounting base is located within a cavity in the window frame with the input shaft and the drive arm extending outwardly from said cavity;

an arm pivotally mounted about a pivot axis that is fixed in position relative to the window frame;

first and second couplings respectively attaching the drive arm and the arm at separate spaced apart positions to a window sash hingedly mounted with the window frame; and a link coupling pivotally mounted to the arm and the drive arm.

5. The combination as claimed in claim 4 further comprising:

a connection member connected with the input shaft; and a handle mounted by the connection member.

6. The combination of claim 5 wherein the connection member is a knuckle joint.

7. A window operator comprising:

a mounting base;

an elongate threaded member located on the mounting base for rotation about a longitudinal axis of rotation;

a threaded element located on the elongate threaded member;

a drive arm pivotally coupled to the threaded element by a pivot coupling;

a link pivotally coupled to an end of the drive arm which is distal from the pivot coupling;

a sash attachment mounted to the link;

an arm pivotally coupled to the mounting base by a pivot coupling, said arm being of longer length than said drive arm;

an end of the arm remote from the pivot coupling the arm to the mounting base being pivotally coupled to a slider mount for mounting with a window sash; and a connection link pivotally coupled to the drive arm adjacent said pivot coupling said drive arm to said threaded element and pivotally coupled to said arm adjacent the pivot coupling said arm to the mounting base.

8. A window operator as claimed in claim 7 wherein the threaded element is adapted to be movable along the threaded member between a first position corresponding to the window sash being in a closed position and a second position corresponding to the window sash being in an open position, the pivot coupling the arm to the mounting base being closer to said thread element when in said second position than when in said first position.

9. A window operator as claimed in claim 8 wherein the pivot coupling said drive arm to said threaded element includes a slider slidingly retained in a guide.

10. A window operator, comprising:

a drive mechanism;

a drive element movable on a rectilinear path by the drive mechanism;

a first linkage of which a primary point of rotation is fixed relative to the drive mechanism;

a first mounting for attachment of the first linkage to a window sash at a first position; a first pivot coupling pivotally coupling said first mounting to said first linkage;

a second linkage connected to the drive element;

a second mounting for attachment of the second linkage to the window sash at a second position which is closer to a side of the window sash which is hinged to a window frame than the first position; a second pivot coupling pivotally coupling said second mounting to said second linkage; and an interconnection linkage extending between and pivotally coupled to the first and second linkages.

11. The window operator of claim 10, wherein the first linkage is a single arm and the first mounting is a slide in a track, the single arm being pivotally coupled to the slide.

12. The window operator of claim 10, wherein the second linkage is formed by a drive arm pivotally coupled to the drive element and a link arm pivotally attached to the drive arm, the second mounting being pivotally coupled to a distal end of the link arm.

13. The window operator of claim 12, wherein the interconnection linkage is pivotally coupled to the drive arm adjacent the pivotal coupling of the drive arm to the drive element, wherein the interconnection linkage is pivotally coupled to the first linkage closer to the primary point of rotation than the first mounting.

14. The window operator as claimed in claim 12, wherein the second mounting includes an L-shaped bracket.

15. The window operator of claim 10, wherein the drive element is a threaded nut and the drive mechanism is a threaded elongated member on which the threaded nut is threadingly engaged, the drive mechanism further including an input shaft drivingly coupled to the threaded elongated member.

16. The window operator of claim 15, wherein the threaded nut further includes a slider.

17. A window operator in combination with a window frame the window operator comprising:

a mounting base located within a cavity in the window frame;

an elongate threaded member mounted on the mounting base for rotation about a longitudinal axis of rotation;

a drive input shaft drivingly connected to the threaded member, said drive input shaft extending through a part of the window frame to be accessible externally of the cavity;

a threaded element located on the elongate threaded member;

a drive arm pivotally coupled to the threaded element by a pivot coupling;

a link pivotally coupled to an end of the drive arm which is distal from the pivot coupling;

a sash attachment mounted to the link;

an arm pivotally coupled to the mounting base by a pivot coupling, said arm being of longer length than said drive arm;

an end of said arm remote from the pivot coupling the arm to said mounting base being pivotally coupled to a slider mount; and an interconnecting link pivotally coupled to the drive arm adjacent said pivot coupling said drive arm to said threaded element and pivotally coupled to said arm adjacent the pivot coupling said arm to the mounting base.

18. The combination of claim 17 further including a window sash hingedly mounted to the window frame, the sash attachment being attached to the window sash at a hinge side thereof and the slider mount being mounted to an edge of the sash.

* * * * *

UNITED STATES PATENT AND TRADEMARK OFFICE

CERTIFICATE OF CORRECTION

PATENT NO. : 6,314,681 B1
DATED : November 13, 2001
INVENTOR(S) : Moody

It is certified that error appears in the above-identified patent and that said Letters Patent is hereby corrected as shown below:

Column 5,
Lines 36, 42, 48 and 52, after "coupling" please insert -- coupling --.
Line 49, please delete "thread" and insert -- threaded --.
Line 64, after "linkages" please insert -- between respective ends of the first and second linkages --.

Column 6,
Line 53, after "coupling" please insert -- coupling --.

Signed and Sealed this

Fifth Day of April, 2005

JON W. DUDAS
*Director of the United States Patent and Trademark Office*